US012349817B2

(12) United States Patent
Hill

(10) Patent No.: US 12,349,817 B2
(45) Date of Patent: Jul. 8, 2025

(54) MOUNTING SYSTEM, METHOD, AND DEVICE

(71) Applicant: Jayson Hill, Castle Rock, CO (US)

(72) Inventor: Jayson Hill, Castle Rock, CO (US)

(73) Assignee: PUNCH COLLAGE, LLC, Castle Rock, CO (US)

( * ) Notice: Subject to any disclaimer, the term of this patent is extended or adjusted under 35 U.S.C. 154(b) by 377 days.

(21) Appl. No.: 17/752,720

(22) Filed: May 24, 2022

(65) Prior Publication Data

US 2023/0145688 A1 May 11, 2023

Related U.S. Application Data

(60) Provisional application No. 63/338,665, filed on May 5, 2022, provisional application No. 63/277,985, filed on Nov. 10, 2021.

(51) Int. Cl.
*A47G 1/16* (2006.01)

(52) U.S. Cl.
CPC ..... *A47G 1/1613* (2013.01)

(58) Field of Classification Search
CPC ..... A47G 1/1613; A47G 2001/0677; A47G 1/1606
USPC ..... 40/713, 777, 778
See application file for complete search history.

(56) References Cited

U.S. PATENT DOCUMENTS

| | | | |
|---|---|---|---|
| D112,534 | S | 12/1938 | Olszewski et al. |
| D181,474 | S | 11/1957 | Antonio |
| 3,861,639 | A | 1/1975 | Morrill |
| D243,510 | S | 3/1977 | Shirey et al. |
| 4,228,982 | A | 10/1980 | Sellera |
| 4,437,639 | A | 3/1984 | Stein |
| D275,868 | S | 10/1984 | Ake |
| D280,433 | S | 9/1985 | Lincir |
| D361,260 | S | 8/1995 | Trentham |
| 6,880,259 | B1 | 4/2005 | Schultz |
| D506,919 | S | 7/2005 | Munson et al. |
| 8,333,026 | B2 | 12/2012 | Southard |
| 9,183,006 | B2 | 11/2015 | Turcotte et al. |
| 9,215,941 | B1 | 12/2015 | Kressin |
| 9,279,538 | B1 | 3/2016 | Wening |
| 9,395,044 | B2 | 6/2016 | Cheng |
| D821,188 | S | 6/2018 | Smullen |

(Continued)

FOREIGN PATENT DOCUMENTS

| | | | |
|---|---|---|---|
| JP | 2004-305723 | A | 11/2004 |
| JP | 2018075354 | A | 5/2018 |

(Continued)

OTHER PUBLICATIONS

"Final Office Action received for U.S. Appl. No. 17/899,306, Mailed on May 17, 2024".

(Continued)

*Primary Examiner* — Kimberly T Wood
(74) *Attorney, Agent, or Firm* — Kutak Rock LLP; Neil Arney; Brian L. Main

(57) ABSTRACT

The present invention relates to a system, method, and device for mounting pictures, art, and other framed images on a wall or other mounting surface by creating a receptacle in the rabbet area of the frame for the framed image wherein the receptacle fits onto a mounting plate that is attached to the mounting surface.

34 Claims, 15 Drawing Sheets

(56) References Cited

U.S. PATENT DOCUMENTS

| | | | | |
|---|---|---|---|---|
| 10,307,001 | B1 | 6/2019 | Fitzpatrick | |
| 10,331,319 | B2 | 6/2019 | Travis et al. | |
| D950,656 | S | 5/2022 | Andersson | |
| 11,690,464 | B2 * | 7/2023 | Spiro | A47G 1/17 40/747 |
| D1,018,733 | S | 3/2024 | Cardona | |
| 2006/0186306 | A1 | 8/2006 | Castle | |
| 2011/0138666 | A1 | 6/2011 | Borde et al. | |
| 2015/0132528 | A1 | 5/2015 | Pirayesh et al. | |
| 2015/0208835 | A1 | 7/2015 | Floyd et al. | |
| 2015/0216331 | A1 | 8/2015 | Sanchez | |
| 2017/0055732 | A1 | 3/2017 | Krake et al. | |
| 2017/0200286 | A1 | 7/2017 | Saleem et al. | |
| 2019/0024370 | A1 | 1/2019 | Wiggins | |
| 2019/0045948 | A1 | 2/2019 | Gale | |
| 2022/0000287 | A1 | 1/2022 | Levis | |
| 2023/0110622 | A1 * | 4/2023 | Hill | A47G 1/1613 248/467 |
| 2023/0146157 | A1 * | 5/2023 | Hill | A47G 1/1606 248/544 |

FOREIGN PATENT DOCUMENTS

| | | | |
|---|---|---|---|
| KR | 10-2012-0000275 | A | 1/2012 |
| KR | 10-20140007220 | A | 1/2014 |
| WO | 2023034314 | A1 | 3/2023 |
| WO | 2023086128 | A1 | 5/2023 |

OTHER PUBLICATIONS

"International Search Report and Written Opinion for International Application No. PCT/US2022/030776, Search completed on Sep. 16, 2022 Mailed on Sep. 16, 2022."

"Non-Final Office Action received for U.S. Appl. No. 17/899,306, Mailed on Jul. 6, 2023", 14 Pages.

"International Search Report and Written Opinion for International Application No. PCT/US2022/042060, Search completed on Dec. 16, 2022, Mailed on Dec. 16, 2022."

"Notice of Allowance Received for U.S. Appl. No. 17/899,306, Mailed on Sep. 11, 2024".

* cited by examiner

MOUNTING SYSTEM, METHOD, AND DEVICE

CROSS-REFERENCE TO RELATED APPLICATIONS

This application claims priority pursuant to 35 U.S.C. 119(e) to U.S. Provisional Patent Application, Ser. No. 63/277,985, filed Nov. 10, 2021, the entire disclosures of which are incorporated herein by reference.

This application claims priority pursuant to 35 U.S.C. 119(e) to U.S. Provisional Patent Application, Ser. No. 63/338,665, filed May 5, 2022, the entire disclosures of which are incorporated herein by reference.

FIELD OF INVENTION

The present invention relates to a system, method, and device for mounting pictures, art, and other framed images on a wall or other mounting surface.

BACKGROUND

It is common to frame photographs, pictures, artwork, graphic designs or other images (collectively "images") prior to displaying them on a wall or other vertical surface. There are various known methods and devices that may be used to hang or mount framed images on a wall or vertical surface.

A common method for framing images for display includes (a) a frame that may be wood, metal, plastic or other rigid material; (b) glass or clear plastic placed in the frame; (c) matting to help highlight the image or make the image more decorative; (d) the image being framed; (e) paper or matting on the backside of the image; and (f) foam board to help keep the image and other materials in the frame (the "framing materials"). The recessed area in the back of the frame where the framing materials are placed is known as the "rabbet." The framing materials are generally secured within the rabbet by using pins, staples or other similar and known fasteners. A paper, plastic or cloth dust cover is then attached to the back of the framed image to conceal the remaining rabbet area of the frame.

Once an image is framed, there are various known methods and devices for mounting or hanging the framed image. Absent from the known methods and devices for mounting a framed image is an efficient method or device for mounting a framed image that utilizes the framing process and materials and easily allows the framed image to be mounted over a predetermined point on a mounting surface, leveled on the mounting surface, and securely mounted on the mounting surface so that the framed image is flush to the mounting surface.

SUMMARY OF INVENTION

The following summary is provided to facilitate an understanding of some of the innovative features unique to the present invention. The present invention is not intended to be limited by this summary.

The present invention relates to a system, method, and device for mounting framed images on a wall or other mounting surface. In a preferred embodiment, the mounting system and method of the present invention utilizes the space within the rabbet of the frame to form a receptacle for a mounting plate that is mounted onto the mounting surface. The receptacle is formed by cutting a hole at or near the center of foamcore that is placed at the back of the framed image. Using foamcore is beneficial because of its light weight and rigid structure, but other dimensional mediums may be used as the frame backing material, such as wood, plastic or metal. In a preferred embodiment, a cup or ring is placed inside the cut-out area of the foamcore to create a three-dimensional receptacle that is designed in shape and size to fit onto a mounting plate that is removable affixed to a mounting surface. The cup or ring is secured to the foamcore by a thin coupling plate that secures the cup or ring in place, forming a sandwich with the foamcore at the center. In an embodiment of this invention, the foamcore has a thickness of at least one-half inch, allowing the resulting receptacle to have a depth of approximately one-half inch.

In a preferred embodiment, the receptacle and mounting plate are made of plastic or other rigid material and are of a shape, size and thickness that support the weight of the framed image. The shape, size and thickness of the mounting plate is designed to fit removably into the receptacle and allow the image to be mounted flush to the wall or other surface. The term "flush" as used herein means that the backside surfaces of the framed image are parallel to and touching or nearly touching the mounting surface.

In a preferred embodiment, the mounting plate has a bulls-eye like opening at the center with targeting guides for ease of locating a predetermined mark on a wall and placing the center of the mounting plate over that predetermined mark. An embodiment of the present invention also includes a bubble vial or other leveling means fixedly or removably attached to the mounting plate for leveling the mounting plate before removably affixing the mounting plate to a wall or other surface. The shape, size, and orientation of the receptacle on the back of the image allow the framed image to be level when placed onto a level mounting plate. Once the mounting plate is level and removably affixed to the mounting surface, the receptacle at the back of the framed image is placed over and onto the mounting plate, creating a mounted, level image.

In an embodiment of the present invention, the mounting plate may be removably affixed to the wall or other surface by using known materials such as adhesive strips, adhesive tapes, adhesives, or using known mechanical fasteners, such as screws or nails. In an embodiment, the bulls-eye like opening at the center of the mounting plate is designed to receive a mechanical fastener for a more rigid and stable attachment of the mounting plate to the mounting surface. In an embodiment, the mounting plate includes one or more angled openings to allow nails or other fasteners to pass through the mounting plate and affix the mounting plate to the mounting surface. In such an embodiment, the combined use of an adhesive strip on the back of the mounting plate and angled fasteners allows large, heavy images to be mounted with minimal damage to the mounting surface.

In an embodiment, the back side of the mounting plate includes one or more standoffs that are spring-loaded or that flex and/or break away that allow the mounting plate to be leveled before pressing it against the mounting surface to engage an adhesive strip to removably affix the mounting plate to the mounting surface. After the mounting plate is placed over the predetermined mark on a mounting surface, leveled and removably affixed to the wall, the receptacle at the back of the framed image is placed over and onto the mounting plate for a secure, level mounting of the image.

In an embodiment of the present invention, the receptacle is elongated along the y-axis to allow the receptacle to fit onto the mounting plate, slide downward, and removably lock onto the mounting plate. This makes the mounting of the framed image more secure and prevents the mounted image from easily slipping off of the mounting plate. Other means for securing the receptacle onto the mounting plate may be used, including frictional material such as rubber, magnets, or other mechanical means for providing friction between the inner edge of the receptacle and the outer edge of the mounting plate to form a more stable connection between the mounting plate and receptacle.

In an embodiment of the present invention, the receptacle and the mounting plate are hexagonal, but may take any common shape, including pentagonal, octagonal, triangular, rectangular, square, any other polygonal shape, circular, oval, etc.

The present invention advantageously allows for a secure mounting of a framed image over a predetermined point on a mounting surface so that the image is level and flush to the mounting surface. The present invention also allows for mounting of multiple framed images on a mounting surface by using templates that identify the center of each image where the receptacle is to be located and thus the center of the mounting plate. These predetermined locations for the mounting plates within a collage can be identified and placed onto the mounting surface using the template and without additional measurements. A preferred embodiment of the present method for use in mounting a collection of images includes a selection from predetermined templates for arranging the collection of images into various collages based on the number, size, and shape of the images. The templates, which may be temporarily placed or projected onto the mounting surface, identify the location of the receptacle on the back of each image of the collage and the center of each receptacle. That information facilitates the placement of predetermined marks on the wall for the center of the mounting plate of each image within the collage. A mounting plate is then located over each predetermined mark on the wall, leveled, and removably adhered to the surface of the wall. The receptacle on the back of each image will fit onto the mounting plate in the location established by the template, making a collage layout of properly located and level images. No additional measurements are required and no additional leveling of images is required.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DESCRIPTION OF DRAWINGS

The accompanying figures are incorporated herein and form a part of the specification for the present invention. The figures further illustrate the present invention.

DETAILED DESCRIPTION OF INVENTION

Figure 1:
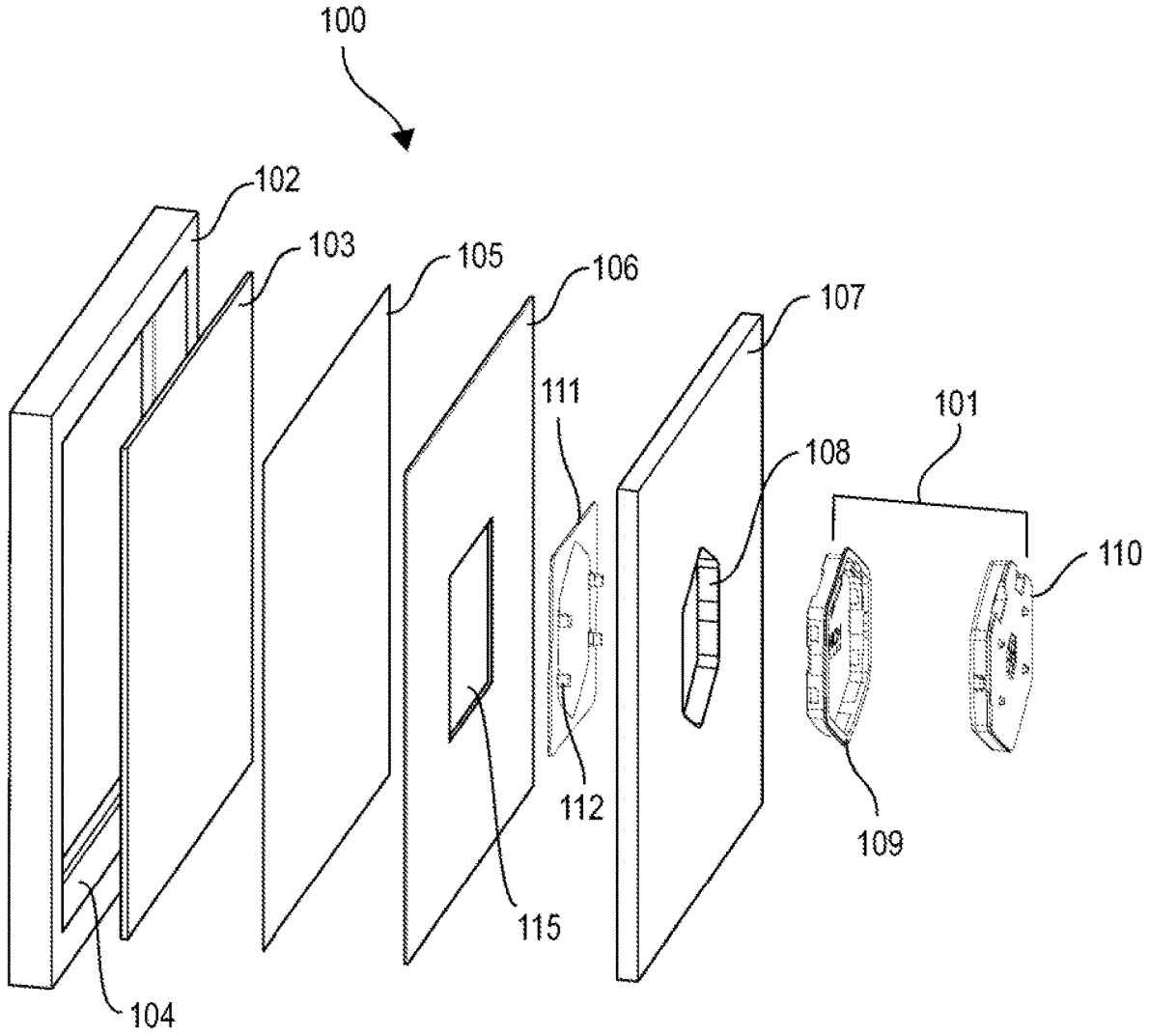
FIG. 1 is an exploded perspective side view showing a framed image with a mounting device according to an embodiment of the present invention.

The present invention is best understood by reference to the detailed drawings and description set forth herein. Embodiments of the invention are discussed below with reference to the drawings. However, those skilled in the art will readily appreciate that the detailed description given herein with respect to the drawings is for explanatory purposes as the invention extends beyond the limited embodiments described. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number for a claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations. However, the use of such phrases should not be construed to imply a claim recitation by the indefinite articles "a" or "an" limits any particular claim containing such claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of claim recitations is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Throughout this disclosure, examples will be provided for using the mounting system, method, and device disclosed. However, those skilled in the art will appreciate additional applications for the mounting system, method, and device. Uses of the present invention may relate to, for example, mounting one or more prints, pictures, photographs, collages, wall art, artwork, or other images on a wall or other mounting surface.

The invention provides a system, method, and device for mounting a single framed image or a plurality of framed images on a wall or other mounting surface. In a preferred embodiment of this invention, the image is framed with the rabbet area of the frame having a depth of one-half inch or greater. The image is framed according to generally known practices, which may include glass or clear plastic at the front of the rabbet area, matting or other decorative features in front of the image, the image, matt board or cardboard after the image, followed by a rigid foamcore to hold the framing materials in place. Foamcore or foam board is a preferred backing because of its relative lightweight, rigidity, strength, and ease of cutting, but other dimensional medium such as wood, plastic, or metal could be used as the backing of the framed image for the present invention.

In an embodiment of the present invention, an area at or near the center of the foamcore backing or other medium is cut out to form a cut-out receptacle for a mounting plate. In a preferred embodiment, the cut-out receptacle is located at or near the center of the image on the x-axis and at or above the center on the y-axis. Benefits of creating a receptable at the back of the framed image is that it provides a sturdy, stable mounting of the framed image and allows the image to be mounted flush to the wall or other mounting surface.

The cut-out receptacle is shaped to receive a mounting plate that is designed to fit into the cut-out receptacle. In another embodiment, the cut-out receptacle is designed to receive a cup or ring that is fixedly attached in the cut-out of the foamcore backing to form an engineered receptacle for receiving the mounting plate. In a preferred embodiment, the cup or ring is fixedly attached in the cut-out using a coupling plate that forms a sandwich with the foamcore in between the coupling plate and receptacle cup or ring. In a preferred embodiment, the cup, ring and coupling plate are plastic or another lightweight rigid material.

In a preferred embodiment, the foamcore backing is fixedly attached in the rabbet area of the frame using corner and/or side brackets that are then affixed to the back of the frame using staples or other known fasteners. Use of the corner and side brackets ensures that the foamcore backing is located even with the back of the frame even if the rabbet is deeper than the thickness of the foamcore backing. This allows the framed image to be flush with the mounting surface when mounted.

In a preferred embodiment, the mounting plate is made of plastic or other rigid material and is of a shape, size and thickness that supports the weight of the framed image. The mounting plate is designed in shape, size, and thickness to fit removably into the receptacle and allow the framed image to be mounted flush to the wall or other mounting surface. In a preferred embodiment, there is a means for removably connecting the mounting plate in the receptacle. In one embodiment, the receptacle is elongated to allow the mounting plate to fit into the receptacle and then slide up and removably lock into place. Such an embodiment creates a stable, lasting connection between the mounting plate and receptacle and significantly reduces the chances that the receptacle will slip off of the mounting plate. In other embodiments, there is a means for providing friction between the inner surface of the receptacle and the outer edges of the mounting plate to form a more stable connection between the mounting plate and receptacle. The frictional means may be mechanical or a material, such as a rubber, plastic, or cloth gasket, that provides friction between the inner surface of the receptacle and the outer edges of the mounting plate. In an embodiment, the frictional means includes engineered tolerances between the inner surface of the receptacle and the outer edges of the mounting plate to create friction when punched or pushed together. In another embodiment, the frictional means includes the use of magnets on the mounting plate and within the receptacle. The receptacle and the mounting plate may take any common shape, including hexagonal, pentagonal, octagonal, triangular, rectangular, square, star, any other polygonal shape, circular, oval, clover leaf, heart, etc.

In a preferred embodiment, the mounting plate has a bulls-eye-like opening at the center with targeting guides for ease of locating a predetermined mark on a wall and placing the center of the mounting plate over that predetermined mark. An embodiment of the present invention also includes a vial level or other leveling means fixedly or removably attached to the mounting plate for leveling the mounting plate before removably attaching the mounting plate to a wall or other surface. The shape, size, and orientation of the receptacle on the back of the framed image are engineered so that the framed image will be level when placed onto a level mounting plate.

In an embodiment of the present invention the mounting plate may be removably affixed to a wall or other surface by using known materials such as adhesive strips, adhesive tapes, adhesives, or by using mechanical fasteners, such as screws or nails. The size and shape of the receptacle and corresponding mounting plate are determined based on the size and weight of the image. An image that is larger and heavier may require a larger receptacle and corresponding mounting plate.

In an embodiment, the bulls-eye like opening at the center of the mounting plate is designed for use with a mechanical fastener for a more rigid, weight-bearing attachment of the mounting plate to the mounting surface. An embodiment of the mounting plate for the present invention also may have one or more downward-angled openings, allowing a fastener to pass through the opening for affixing the mounting plate to the mounting surface. The use of mechanical fasteners through the bulls-eye like opening or through the angled openings allows large, heavy images to be supported by the device of the present invention. For example, the use of fasteners through angled openings in the mounting plate alone or in combination with adhesives placed between the mounting plate and the mounting surface, allows for large, heavy images to be mounted using the mounting system, method, and device of the present invention. A three-inch mounting plate affixed to a wall with adhesive tape and with nails through the downward-angled openings can support an image weighing up to approximately 150 pounds. For larger, heavy images a plurality of receptacles may be cut out of the back of the image and a plurality of mounting plates used to mount the image onto the mounting surface.

In an embodiment, the back side of the mounting plate includes one or more flexible standoffs that allow the device to be leveled before pressing the mounting plate against the wall to engage an adhesive strip or tab to removably adhere the mounting plate to the wall. After the mounting plate is placed over the predetermined mark on a wall surface, leveled, and removably affixed to the wall, the receptacle on the back of the framed image is placed over and onto the mounting plate for a secure, level mounting of the framed image.

The present invention advantageously allows for mounting one or more framed images and laying out such images using templates that identify the center of each image where the mounting plate is to be located. These predetermined locations for the mounting plates within a collage can be identified using such a template and without additional measurements. The present invention also allows the images to be mounted flush to the mounting surface and without any additional leveling of the image.

A preferred embodiment of the present invention for use in mounting a collection of framed images includes a selection of predetermined templates for arranging the collection of images into various collages based on the number, size, and shape of the images. The templates, which may be temporarily placed or projected onto the mounting surface, identify the location of the receptacle on the back of each image of the collage and the center of each receptacle. That information facilitates placement of marks on the wall representing the center of the mounting plate for each image within the collage. A mounting plate is then located over each predetermined mark on the wall, leveled, and removably affixed to the surface of the wall. The receptacle on the back of each image will fit onto the mounting plate in the location established by the template, making a collage layout. A template may be used for a single image or a plurality of images.

Figure 2:
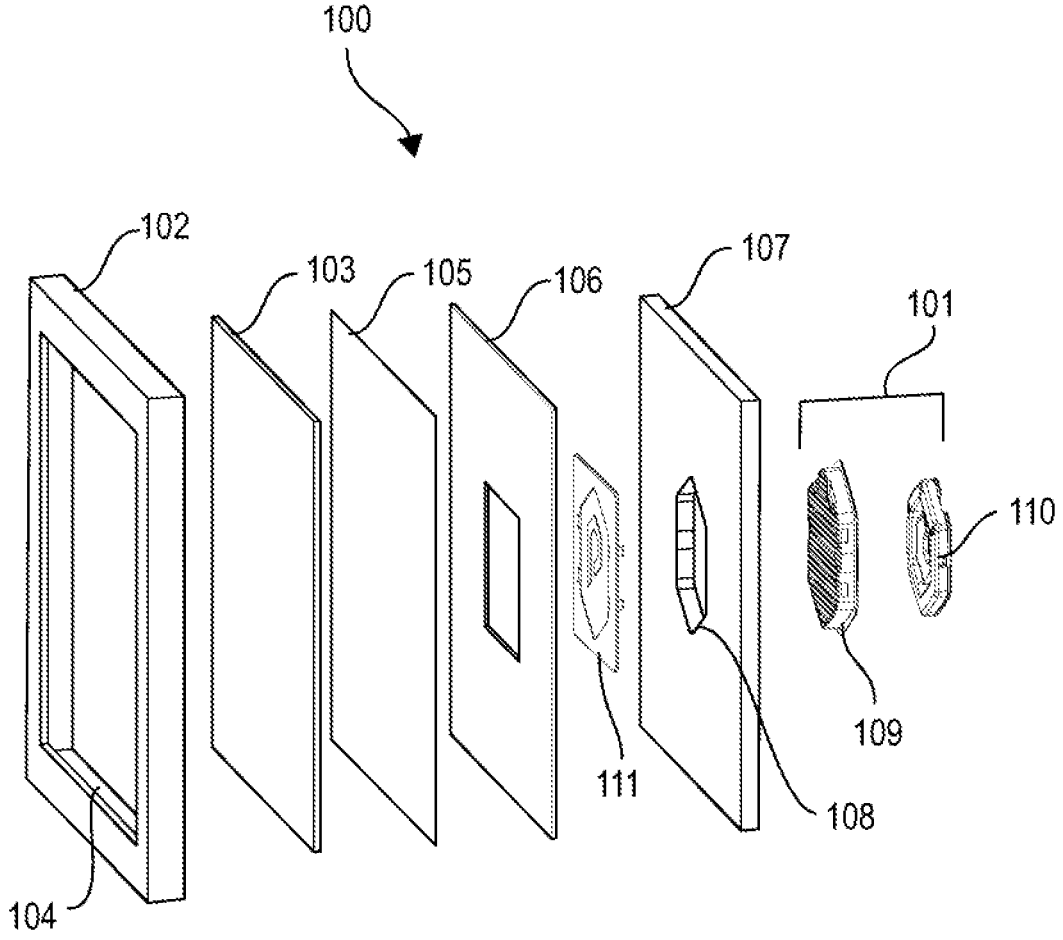
FIG. 2 is an exploded perspective side view showing a framed image with a mounting device according to an embodiment of the present invention.

To illustrate embodiments of the present invention, reference is made to the drawings. FIGS. 1 and 2 provide exploded side views of a framed image 100 with a mounting device 101 of the present invention. The framed image 100 includes (a) a frame 102 that is made of wood, metal, plastic, or other rigid material; (b) glass or clear plastic 103 placed at the front of the rabbet 104 area of the frame; (c) the image 105 being framed; (d) matt board or cardboard 106 to support the image; and (e) foamcore 107 at the back of the rabbet 104 area. In a preferred embodiment of the present invention, an area at or near the center of the foamcore 107 is cut out. The cut-out 108 is located at or near the center of the foamcore 107 on the x-axis and at or above the center of the foamcore 107 on the y-axis. In the embodiments illustrated by FIGS. 1 and 2, a receptacle cup 109 is placed inside the cut-out 108 to form a receptacle for the mounting plate 110. The receptacle cup 109 is of a shape and size to fit inside the cut-out 108 and onto the mounting plate 110. The receptacle cup 109 is locked in place using a coupling plate 111 that is on the opposite side of the foamcore 107 from the receptacle cup 109 and fixedly connects with the receptacle cup 108 with the foamcore 107 sandwiched in between.

Figure 6A:
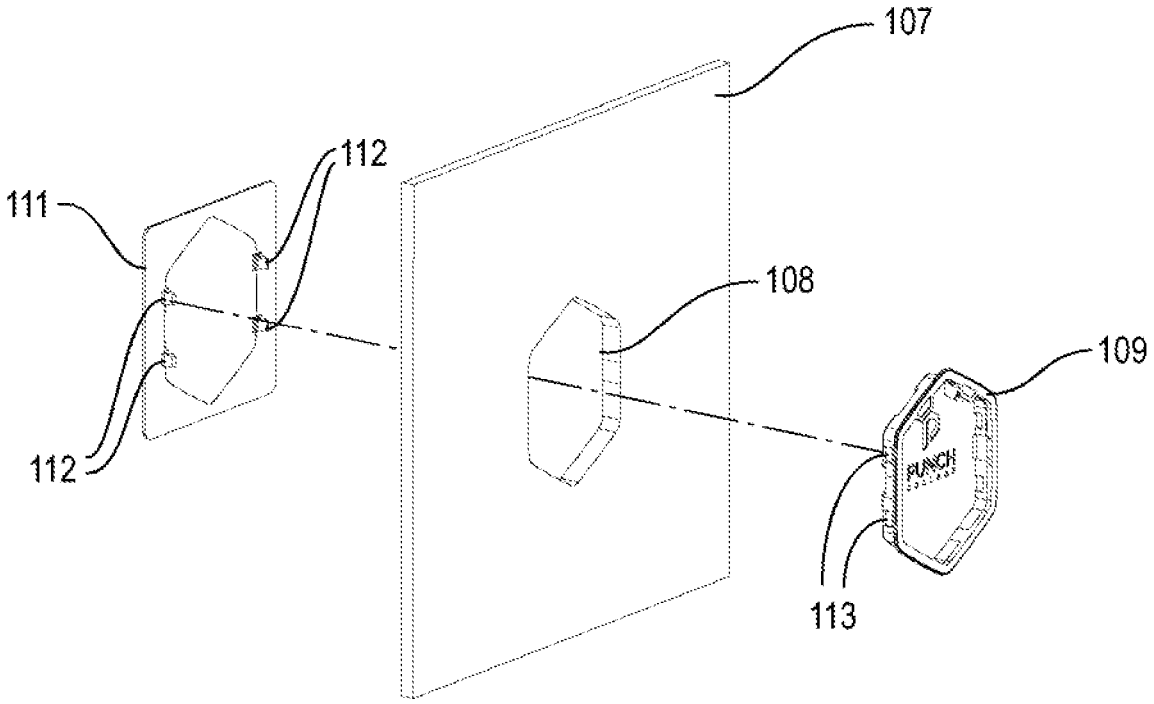
FIGS. 6*a* and 6*b* are perspective rear views of a foamcore backing of a framed image with a hexagonal cut-out, a hexagonal receptacle cup to be placed into the cut-out, and a coupling plate for the hexagonal receptacle cup, according to an embodiment of the present invention.
Figure 6B:
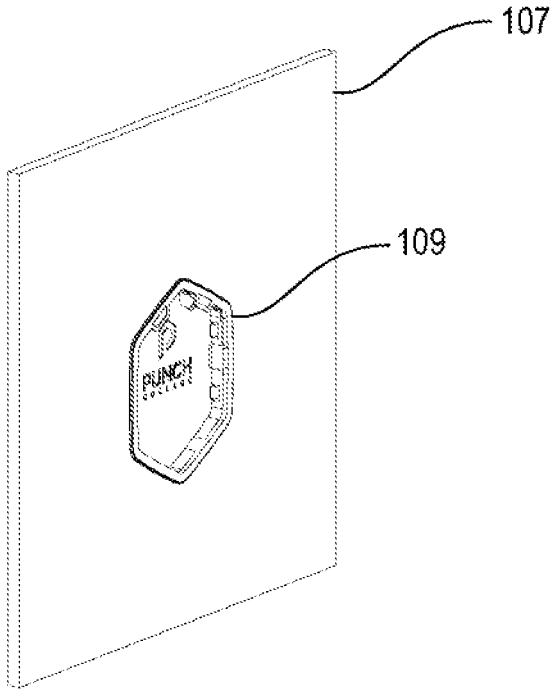
Figure 7A:
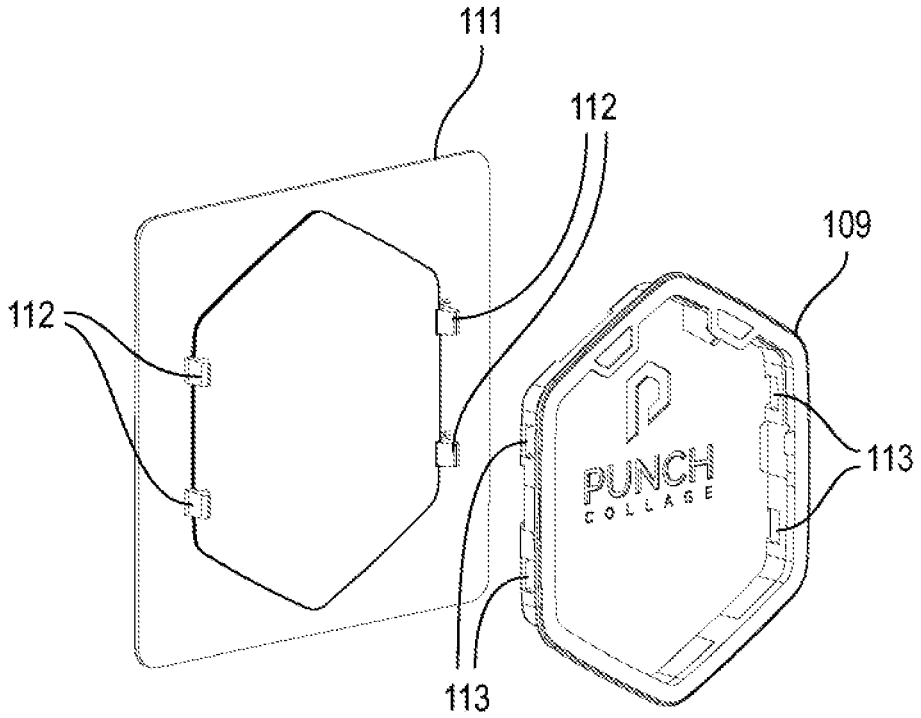
FIGS. 7*a* and 7*b* are perspective views of a hexagonal receptacle cup and a coupling plate for locking the receptacle cup into a cut-out in a foamcore backing, according to an embodiment of the present invention.
Figure 7B:
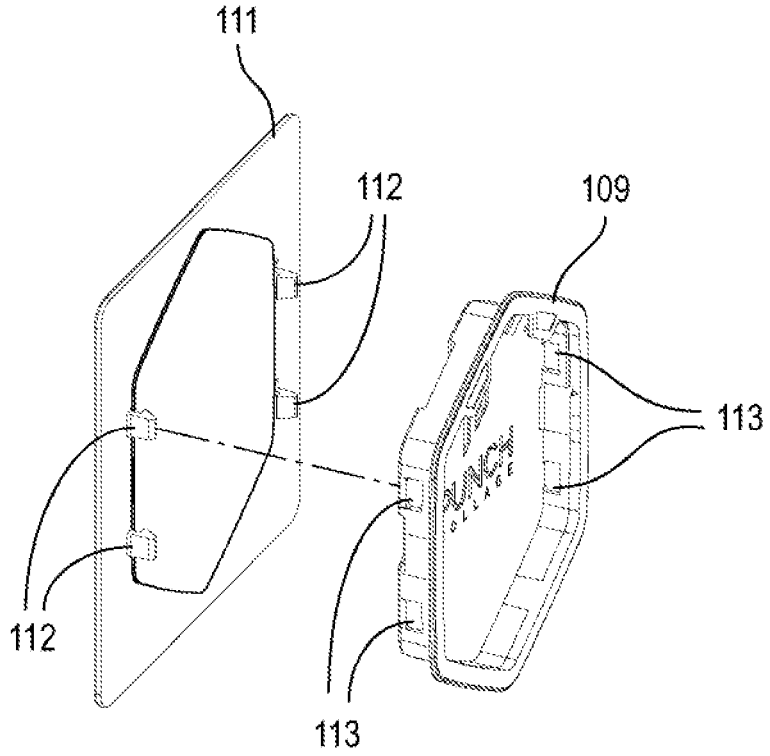

FIGS. 6*a* and 6*b* show an embodiment of a receptacle cup 109, a coupling plate 111, and a cut-out 108 in the foamcore 107 backing. In this embodiment, the receptacle cup 109 is fixedly connected to the coupling plate 111 using a plurality of flexible tabs 112 that flex outward and then lock into grooves 113 in the outer edges of the receptacle cup 109 when the receptacle cup 109 and the coupling plate 111 are pressed together with the foamcore 107 sandwiched in between. FIGS. 7*a* and 7*b* show another embodiment of a receptacle cup 109 and a coupling plate 111 with a plurality of flexible tabs 112 on the coupling plate 111 and a plurality of grooves 113 on the outer edges of the receptacle cup 109 for fixedly connecting the two with the foamcore 107 in between.

Figure 3:
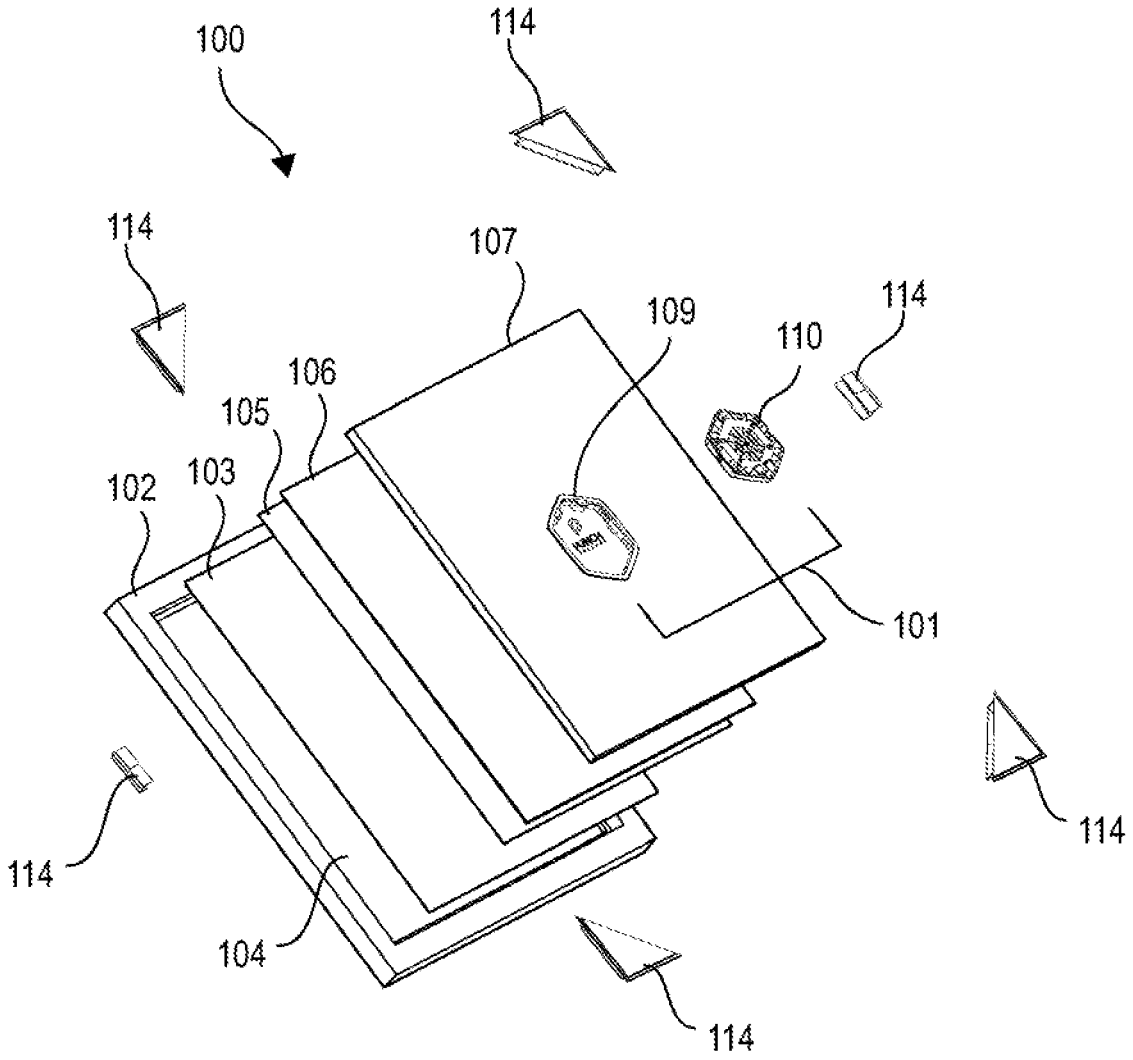
FIG. 3 is an exploded perspective rear view showing a framed image with a mounting device according to an embodiment of the present invention.
Figure 4:
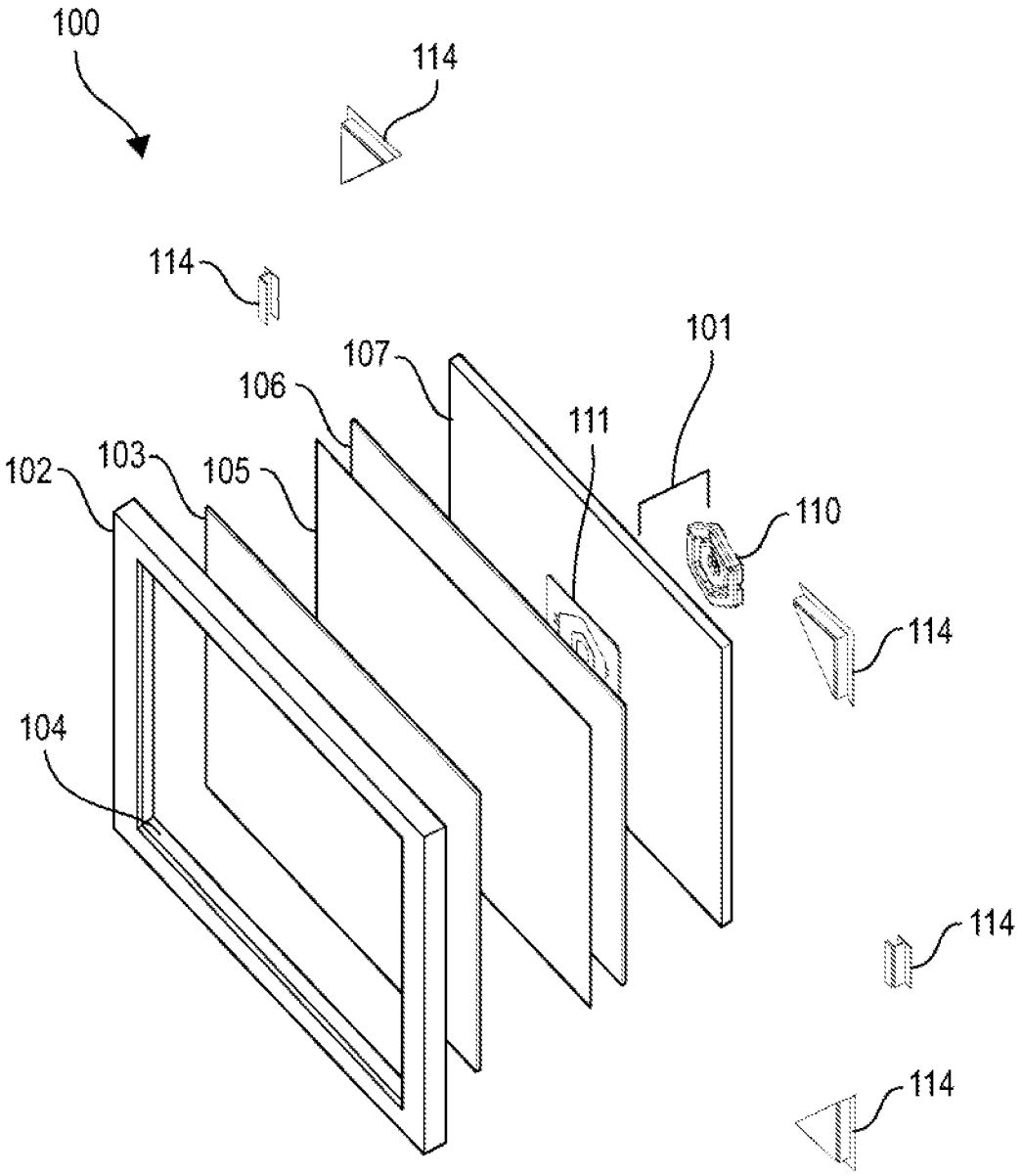
FIG. 4 is an exploded perspective front view showing a framed image with a mounting device according to an embodiment of the present invention.

In embodiments shown in FIGS. 1 and 2, the foamcore backing 107 is a thickness to fill the remaining space of the rabbet 104 so that the backside of the foamcore 107 is even with the back edges of the frame 102. This allows the framed image 100 to be flush with the mounting surface when mounted onto the mounting plate 110. In other embodiments as shown in FIGS. 3 and 4, brackets 114 are used to ensure that the backside of the foamcore 107 is even with the back edges of the frame 102. The brackets 114 are shaped to slide onto the corners or the side and top edges of the foamcore 107 with the outer edges of the brackets 114 overlaying the back edges of the frame 102 allowing the brackets 114 and the foamcore 107 to be fixedly attached to the backside of the frame 102 so that the back of the foamcore 107 is even with the back edge of the frame 102. The brackets 114 are attached to the back of the frame 102 using staples or other known fasteners. The embodiment using the brackets 114 is advantageous when the remaining rabbet 104 depth is greater than one-half inch by allowing use of one-half inch foamcore 107 rather than thicker foamcore 107 backing.

Figure 5:
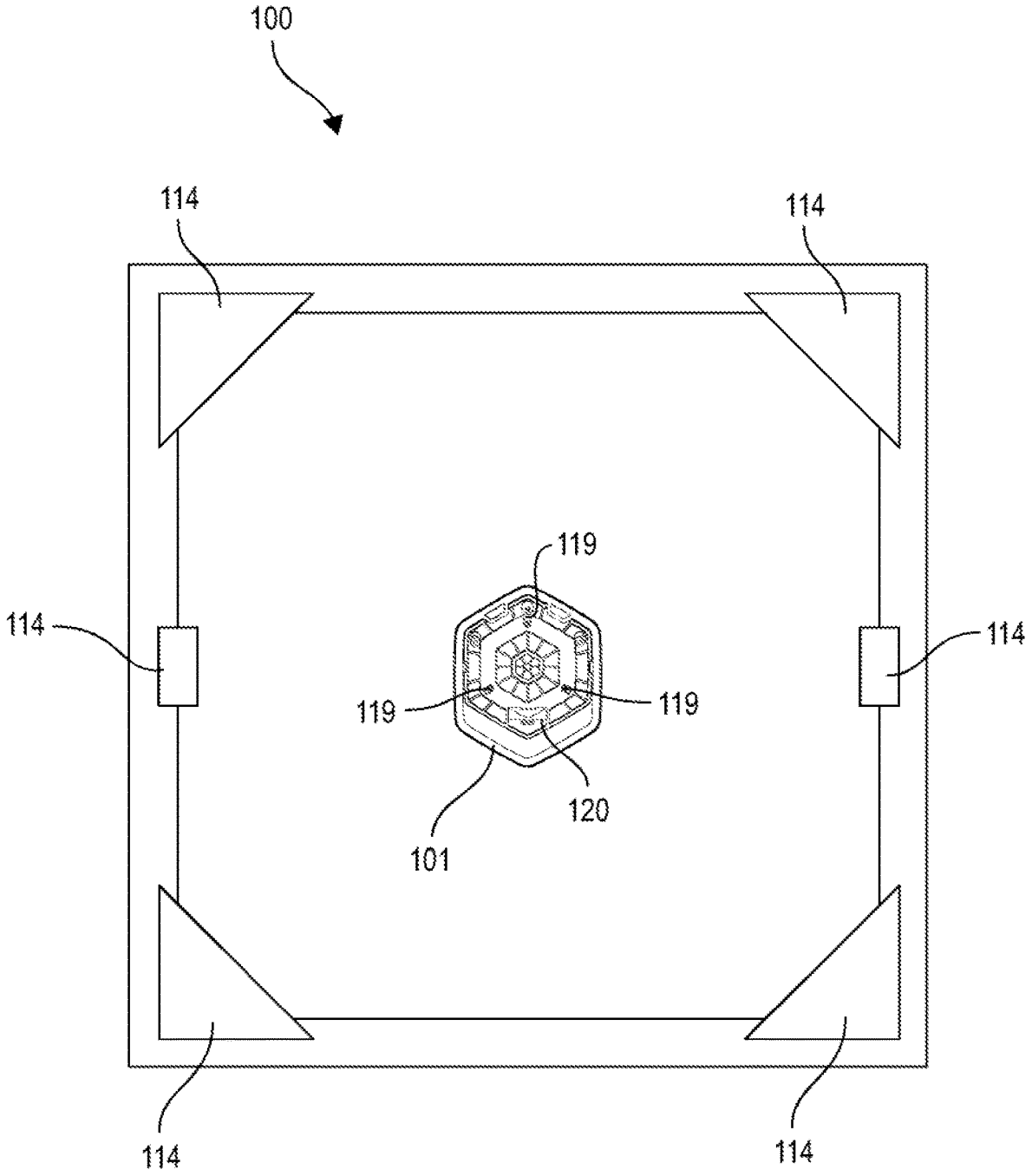
FIG. 5 is rear view of a framed image with a mounting device according to an embodiment of the present invention.
Figure 8:
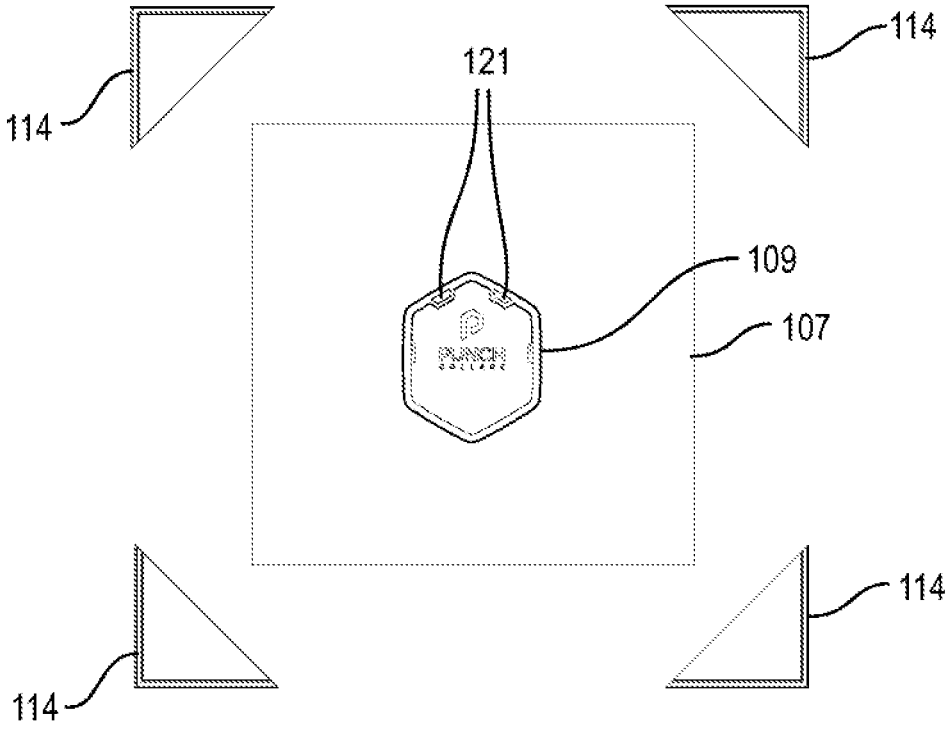
FIG. 8 is a rear view of a foamcore backing with a hexagonal receptacle along with corner brackets for holding the foamcore in place, according to an embodiment of the present invention.

FIG. 5 shows a back view of a framed image 100 using the mounting device 101 of the present invention. FIG. 5 shows the brackets 114 for fixedly attaching foamcore 107 to the backside of a frame 102 so that the back of the foamcore 107 is even with the back edges of the frame 107. This allows the framed image 100 to be mounted flush to the mounting surface. FIG. 8 shows another embodiment of this invention, namely a back view of foamcore 107 backing for a framed image 100 with a receptacle 109 formed at or near the center of the foamcore 107. FIG. 8 also shows a plurality of corner brackets 114 for fixedly attaching the foamcore 107 to the back edges of the frame 102.

In embodiments shown in FIGS. 1 and 2, the matt board or card board 106 has a cutout in the shape of the coupling plate 111. This allows the foamcore 107 backing to be placed against the matt board or card board 106 without distortion from the coupling plate 111. In other embodiments, for example when the remaining rabbet 104 area is greater than one-half inch and the brackets 114 are used, no matt board or cardboard is used to separate the image 105 from the foamcore 107.

In the embodiments shown in FIGS. 1 and 2, the mounting plate 110, the receptacle cup 109, and the coupling plate 111 are made from a rigid plastic, but other rigid materials, such as metal, wood, or composite may be used. In alternative embodiments, a receptacle ring is used instead of a cup to form the receptacle 109 inside the cut-out 108. In another embodiment, no cup or ring is used and the cut-out 108 is sized and designed to receive the mounting plate 110 directly.

In the embodiments shown in FIGS. 1 and 2, the cut-out 108, the receptacle cup 109, and mounting plate 110 are hexagonal, but could be any polygonal shape, or any other shape, such as circular, oval, etc., that provides sufficient support for mounting the framed image 100 to a wall or other surface. In an alternative embodiment, the cut-out 108 may be any shape that is designed to receive a receptacle cup 109 that is polygonal shape or to directly receive a mounting plate 110 that is polygonal.

Figure 9A:
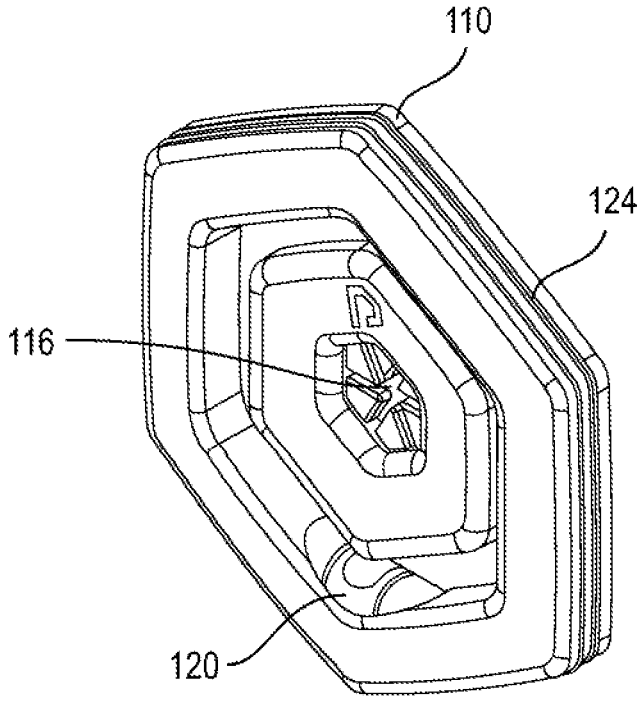
FIGS. 9*a* and 9*b* show a front perspective view and a front view of the mounting plate with a hexagonal shape, according to an embodiment of the present invention.
Figure 9B:
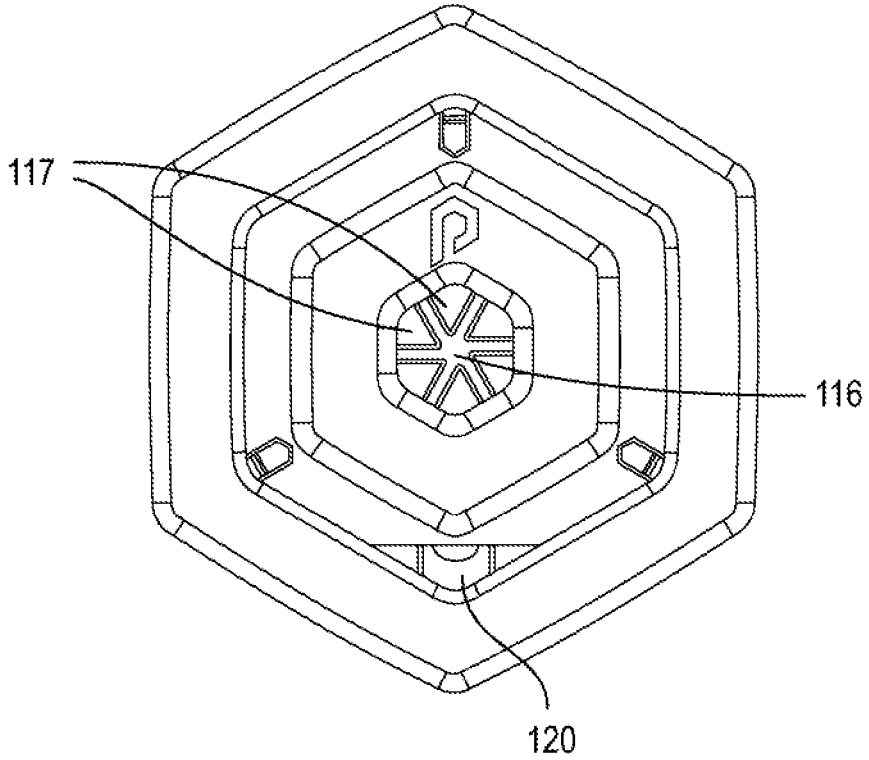
Figure 10A:
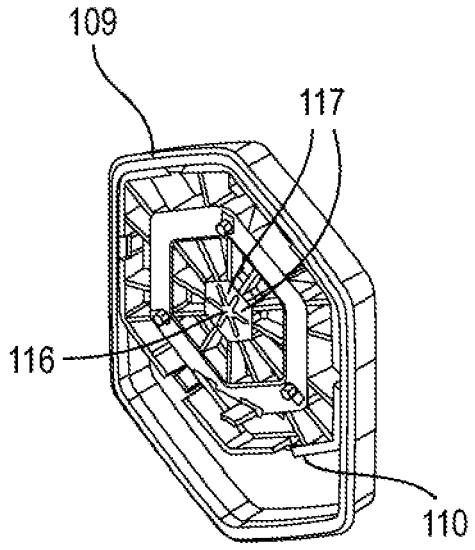
FIGS. 10*a* and 10*b* show a perspective rear view and a rear view of a hexagonal mounting plate inside an elongated hexagonal receptacle, according to an embodiment of the present invention.
Figure 10B:
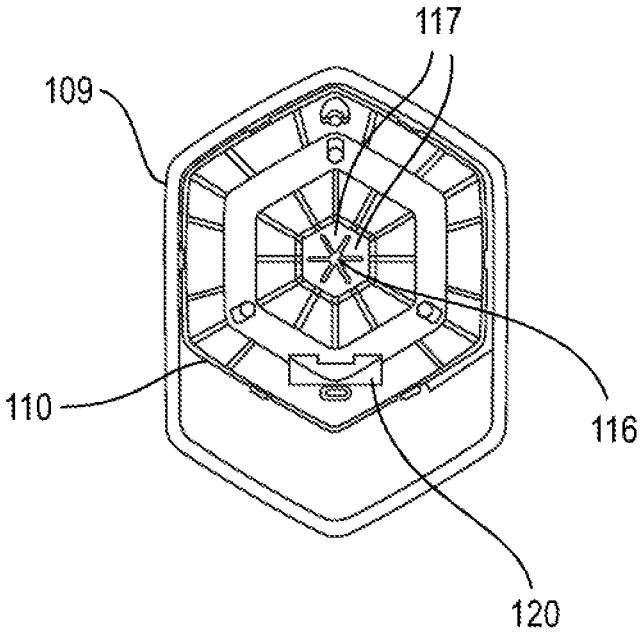
Figure 11:
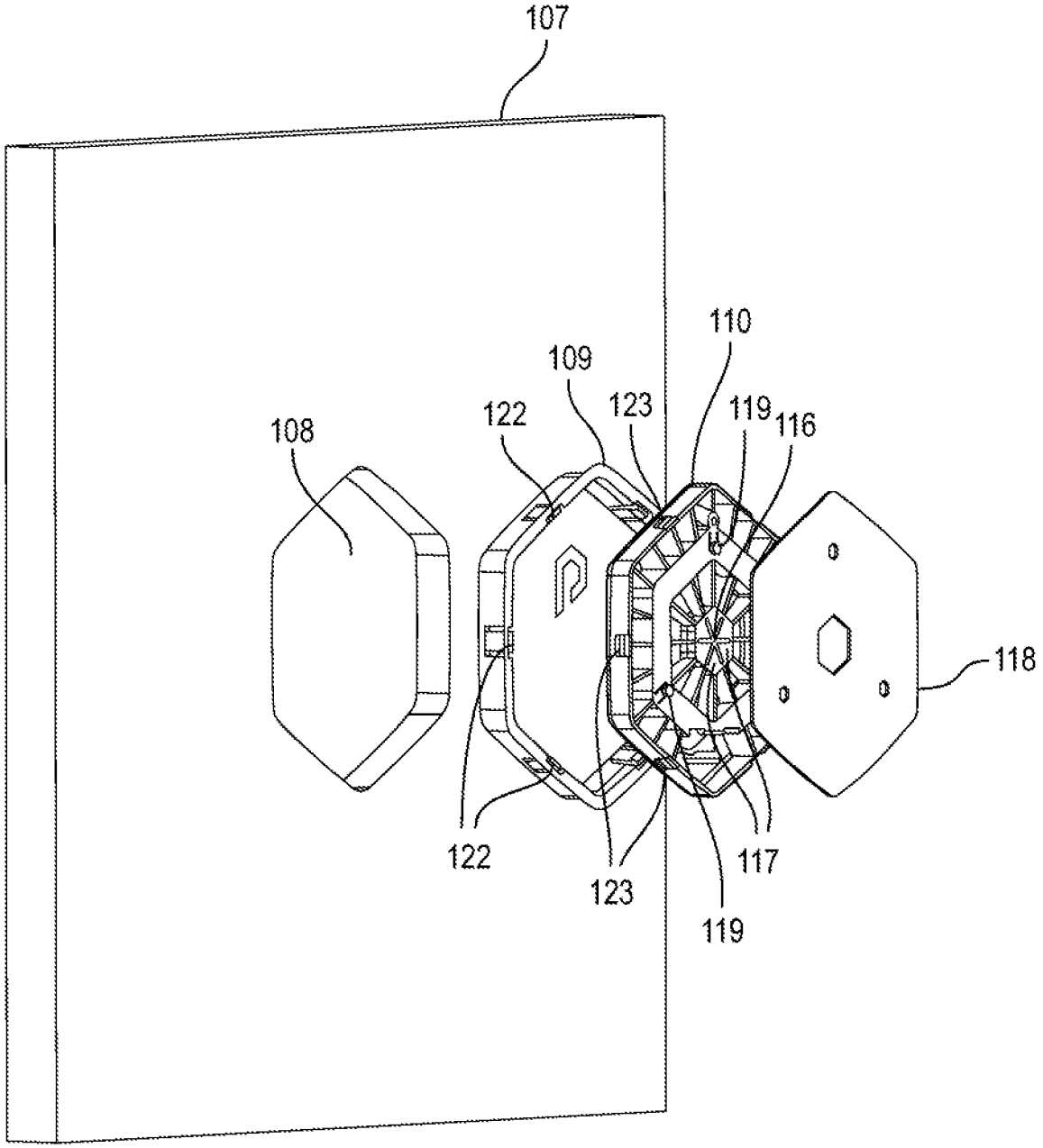
FIG. 11 is a perspective rear view of a foamcore backing for a framed image with a hexagonal cut-out, a hexagonal receptacle cup to be placed into the cut-out, and a hexagonal mounting plate, according to an embodiment of the present invention.

In embodiments shown in FIGS. 9, 10, and 11, the mounting plate 110 includes a bulls-eye like opening 116 and a plurality of targeting guides 117 that allow the mounting plate 110 to be centered over a predetermined mark on a mounting surface. Use of targeting guides 117 within the bulls-eye like opening 116 allows the opening to be larger for ease in locating the predetermined mark on the wall and to aide in placing the center of the mounting plate 110 over the predetermined mark. In a preferred embodiment, the targeting guides 117 are arrow shaped and pointing to the center of the mounting plate, but the targeting guides 117 may take other shapes that identify the center of the mounting plate 110.

In embodiments of this invention as shown in FIGS. 9 and 10, the mounting plate 110 has a bubble vial level 120 fixedly or removably attached to the mounting plate 110 for leveling the mounting plate 110 before it is removably adhered or affixed to a mounting surface. The cut-out 108, the receptacle 109, and the mounting plate 110 are oriented and designed so that the framed image 100 will be level when placed onto a mounting plate 110 that is level on the mounting surface. Alternative leveling means may be used to level the mounting plate 110 before removably adhering or affixing the mounting plate 110 to a mounting surface.

Figure 13A:
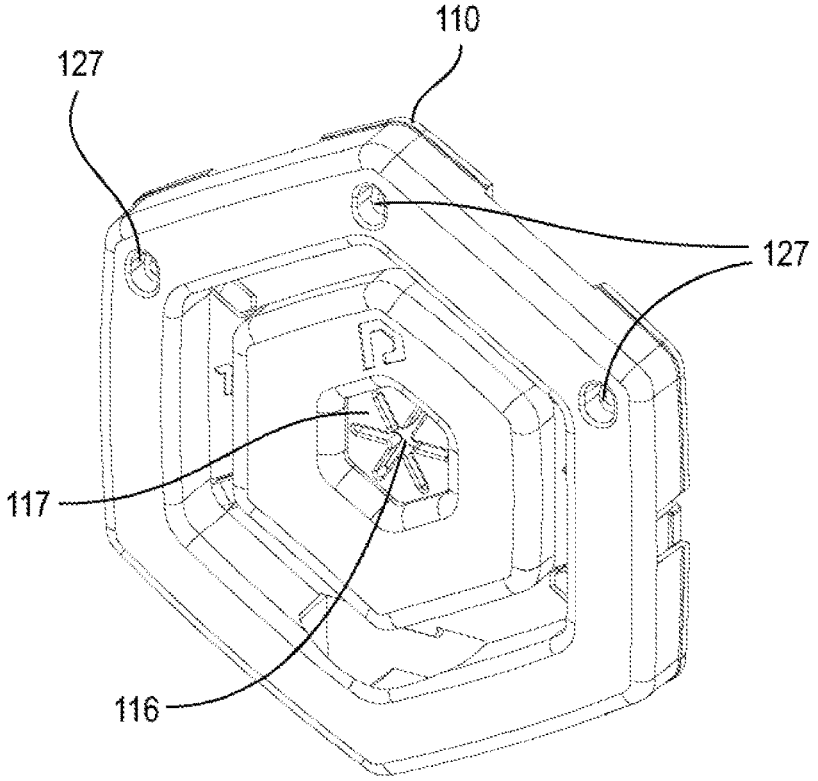
FIGS. 13*a* and 13*b* are a front perspective view and a rear perspective view of a mounting plate showing angled holes for affixing the mounting plate to a mounting surface, according to an embodiment of the present invention.
Figure 13B:
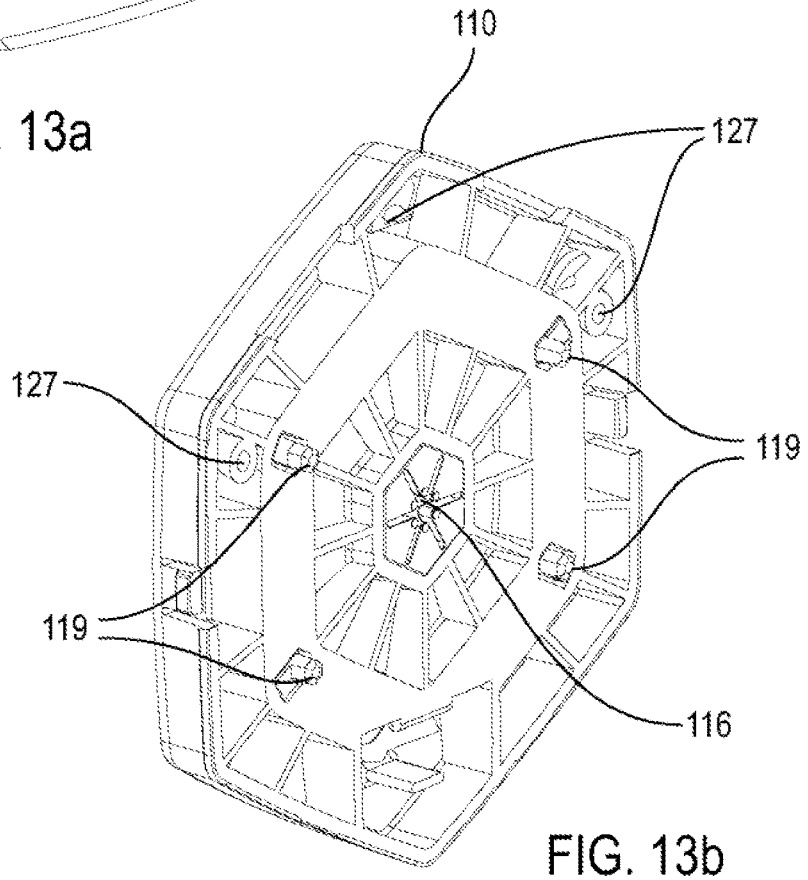

In an embodiment shown in FIG. 11, the mounting plate 110 is removably adhered to a wall or other mounting surface using an adhesive strip 118 that has a size and shape similar to the mounting plate 110. The adhesive strip 118 fixedly adheres to the back of mounting plate 110 and removably adheres to the mounting surface. In such embodiment, the back surface of the mounting plate 110 includes a plurality of flexible standoffs 119 that allow the mounting plate 110 to be centered over a predetermined mark on a mounting surface, held against the wall and leveled using the bubble vial level 120 without engaging the adhesive strip 118 with the mounting surface. When the mounting plate 110 is centered over the predetermined mark on the mounting surface and is leveled, the mounting plate 110 can be pressed against the mounting surface causing the flexible standoffs 119 to flex and/or break, engaging the adhesive strip 118 to removably adhere the mounting plate 110 to the mounting surface. In embodiments, the mounting plate 110 may be removably affixed to a mounting surface using known materials such as adhesive tapes, adhesives, or mechanical fasteners, such as screws or nails. In an embodiment, the bulls-eye 116 like opening at the center of the mounting plate 110 may receive a mechanical fastener for a more rigid and stable attachment of the mounting plate 110 to the mounting surface. In an embodiment, the mounting plate 110 includes one or more angled openings 127 as shown in FIGS. 13*a* and 13*b* to allow nails or other fasteners to pass through the mounting plate 110 and affix the mounting plate 110 to a mounting surface. In such an embodiment, the combined use of an adhesive strip 118 on the back of the mounting plate 100 and fasteners through the angled openings 127 allows large, heavy images to be mounted with minimal damage to the mounting surface.

Figure 12:
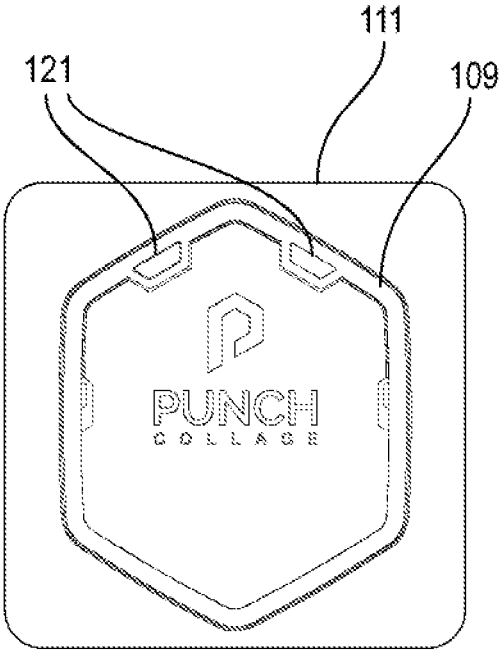
FIG. 12 is a rear view of an elongated receptacle cup and coupling plate, according to an embodiment of the present invention.

In embodiments of the present invention, there is a means for securing the mounting plate 110 in the receptacle 109. In a preferred embodiment, as shown in FIGS. 8, 10 and 12, the receptacle 109 is elongated along the y-axis allowing the receptacle 109 to fit onto the mounting plate 110, slide down onto the mounting plate 110 and removably lock onto the mounting plate 110. As shown in embodiments in FIGS. 8 and 12, the means for locking the receptacle 109 onto a mounting plate 110 includes, one or more protrusions 121 that slide over the mounting plate 110 to prevent the receptacle 109 and the framed image 100 from sliding off of the mounting plate 110.

Other embodiments of the present invention, prevent the receptacle 109 from sliding off of the mounting plate 110 by creating friction between the mounting plate 110 and the receptacle 109. As an example, FIG. 11 shows a mechanical means for removably connecting the mounting plate 110 to the receptacle 109, namely a plurality of male clips 122 at the inner edge of the receptacle 109 and female clips 123 at the outer edge of the mounting plate 110 that clip together to removably connect and lock the mounting plate 110 into the receptable 109 to prevent the framed image 100 from slipping off of the mounting plate 110. In an alternative embodiment, as shown in FIG. 9, the means for creating friction is a rubber gasket 124 on the outer edge of mounting plate 110 and/or a rubber gasket on the inner edge of the receptacle 109. The frictional means provides a more stable mounting of the framed image 100 to prevent the image 100 from inadvertently sliding off the mounting plate 110. In other embodiments, the frictional means may include other known friction causing material on the outer edges of the mounting plate 110 and/or on the inner surface of the receptacle 109. The frictional means may also include other known mechanical means for friction or by engineering and manufacturing the mounting plate 110 and the receptacle 109 so that there is friction between the outer edge of the mounting plate 110 and the inner surface of the receptacle 109 when the image 100 is mounted. The frictional means may also include use of magnets to create a magnetic connection between the mounting plate 110 and the receptacle 109.

Figure 14:
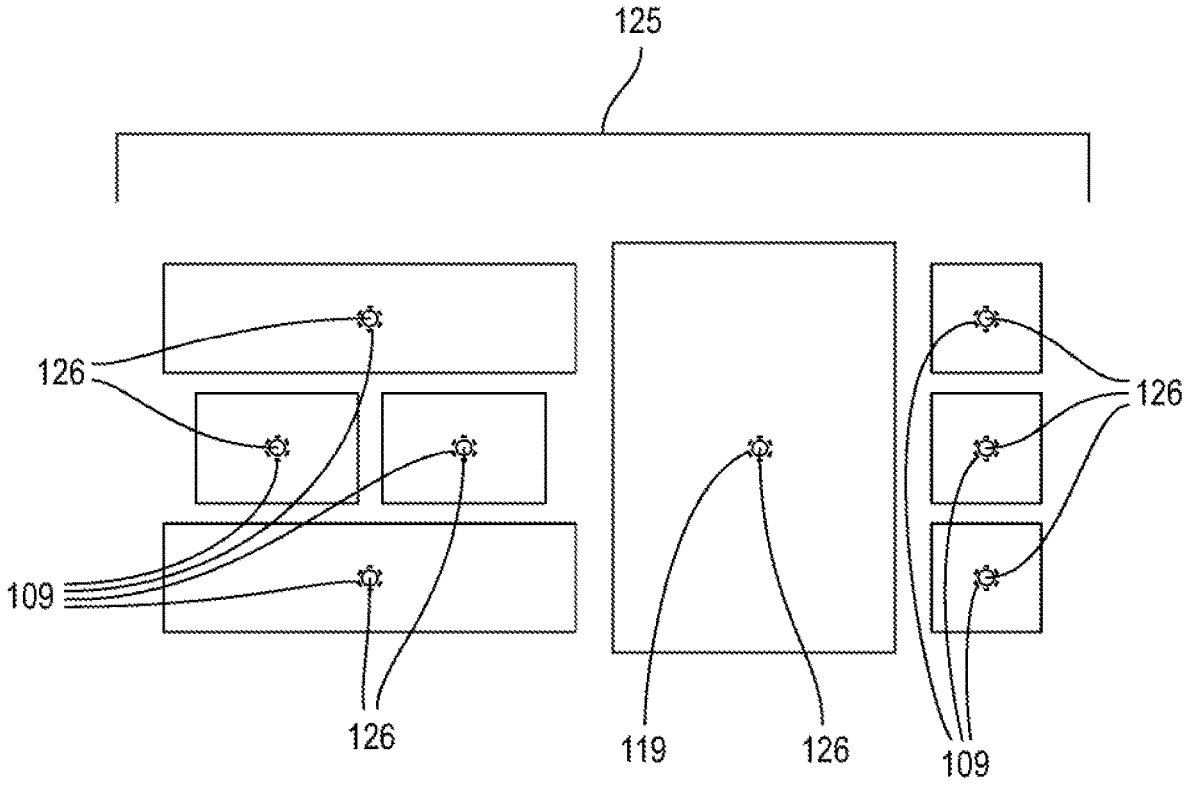
FIGS. 14 and 15 are illustrations of collage templates for use in locating a center of a plurality of framed images on a mounting surface.
Figure 15:
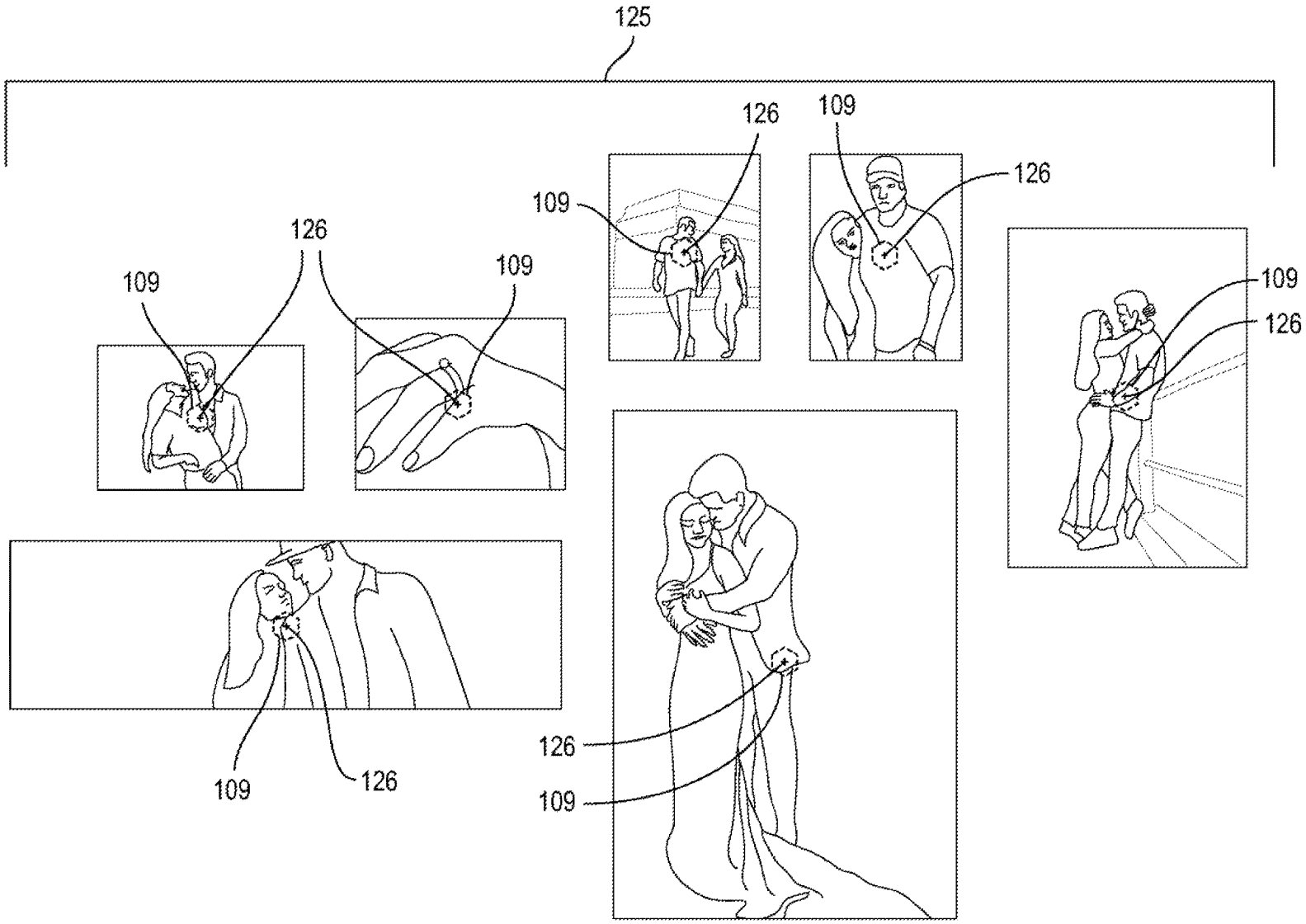

FIGS. 14 and 15 are illustrations of multi-image templates 125 used with the mounting plate 110 of the present invention to locate the center point for each framed image 100 within collection of images. In an embodiment of this invention, a template 125 is selected from a library of predetermined templates for arranging the collection of framed images 100 on a mounting surface to form a collage or other arrangement of images. Each template 125 shows the shape and location of the receptacle 109 on the back of each framed image 100 within the template 125 and also shows the center point 126 of each mounting plate 110 for each image. Once the collage arrangement is selected, images 100 are sized and framed based on the template 125 and then the template 125 may be attached or projected onto the mounting surface and used to identify and mark the center point for each mounting plate 110 to be placed onto the mounting surface.

The present invention advantageously allows for mounting one or more framed images 100 and laying out such framed images 100 using templates 125 that identify the center of each mounting plate 110 for each framed image 100 that is to be mounted on the mounting surface for form a collage or collection of framed images 125. These predetermined locations for the mounting plates 110 within a collection of images 100 can be identified using the template 125 and do not require any additional measurements for locating the center of the mounting plates 110 or the images 100 on the mounting surface. The present invention also advantageously allows the framed images 100 to be mounted level on the mounting surface when the mounting plates 110 are leveled before each mounting plate 110 is removably affixed to the mounting surface and when the receptacle 109 on the back of the images 100 is placed over the level mounting plates 110. Templates 125 may be used for a single image or a plurality of images.

It is to be understood that the foregoing description is intended to illustrate and not limit the scope of the invention, which is defined by the scope of the appended claims. Other aspects, advantages, and modifications are within the scope of the following claims.

What is claimed is:

1. A system for mounting a framed image on a mounting surface, the system comprising:

a mounting plate and a receptacle, wherein the receptacle is fixedly placed into a rabbet area of a frame of the framed image, the receptacle being positioned behind an image of the framed image, and wherein a shape and size of the receptacle are designed for removably placing the receptacle onto the mounting plate;

wherein the receptacle is located in a cut-out at or near a center of a solid-core substrate, wherein the receptacle is fixedly attached into the cut-out using a coupling plate that locks the receptacle into the cut-out with the solid-core substrate between the coupling plate and the receptacle, wherein there is a means for fixedly attaching the solid-core substrate in the rabbet area whereby a back surface of the solid-core substrate is even with one or more back edges of the frame, wherein the mounting plate defines a bull's-eye opening at a center of the mounting plate, the bull's eye opening being configured for aligning the mounting plate over a predetermined point on the mounting surface, wherein the mounting plate contains a means for leveling the mounting plate on the mounting surface before the mounting plate is removably adhered to the mounting surface, wherein the shape and size of the receptacle, and an orientation of the receptacle, allow the framed image to be level on the mounting surface when mounted onto a level mounting plate, and wherein one or both of the receptacle or the mounting plate has a means for preventing the receptacle from sliding off the mounting plate.

2. The system of claim 1 wherein the means for preventing the receptacle from sliding off the mounting plate comprises:

elongating the receptacle along a y-axis to allow the receptacle to be placed onto the mounting plate and slide downward; and one or more protrusions at a top of the receptacle that extend over the backside of the mounting plate to prevent the receptacle from moving away from the mounting surface.

3. The system of claim 1 wherein the means for fixedly attaching the solid-core substrate in the rabbet area comprises a plurality of brackets that slide onto corners or sides of the solid-core substrate whereby the brackets overlay the one or more back edges of the frame and are affixed to a back of the frame.

4. The system of claim 1 wherein the means for leveling the mounting plate on the mounting surface before the mounting plate is removably adhered to the mounting surface is a bubble vial affixed to the mounting plate.

5. The system of claim 1 wherein the means for leveling the mounting plate on the mounting surface before the mounting plate is removably adhered to the mounting surface is a bubble vial removably affixed to the mounting plate.

6. The system of claim 1 wherein said mounting plate has a plurality of standoffs on a backside surface of the mounting plate to allow the mounting plate to be leveled on the mounting surface before the mounting plate is removably adhered to the mounting surface.

7. The system of claim 1 wherein said solid-core substrate is one of foamcore, plastic, wood, composite, or metal.

8. A method for leveling and mounting a framed image on a mounting surface, the method comprising:

placing an image of the framed image in a frame of the framed image, fixedly attaching a solid-core substrate at a back of a rabbet area of the frame, making a cut-out at or near a center of the solid-core substrate for placement of a receptacle, wherein the receptacle is affixed in the cut-out using a coupling plate that locks onto the receptacle with the solid-core substrate in between the receptacle and the coupling plate, wherein a shape and size of the receptacle are designed for removably placing the receptacle over and onto a mounting plate, wherein a shape and size of said mounting plate are designed to fit within the receptacle, wherein said mounting plate defines a bull's-eye opening at a center of the mounting plate, the bull's eye opening being configured for aligning the mounting plate over a predetermined point on the mounting surface, and wherein the mounting plate contains a means for leveling the mounting plate on the mounting surface before the mounting plate is removably attached to the mounting surface, placing the bull's eye opening of the mounting plate over the predetermined point on the mounting surface, leveling the mounting plate on the mounting surface, removably attaching said level mounting plate onto the mounting surface, and placing the receptacle over and onto the level mounting plate;

wherein the shape and size of the receptacle, and an orientation of said receptacle, are designed so that the framed image is level when mounted onto the level mounting plate, wherein one or both of the receptacle or the mounting plate has a means for preventing the receptacle from sliding away from the mounting surface and off of the mounting plate, and wherein the framed image is flush to the mounting surface.

9. The method of claim 8 wherein the means for preventing the receptacle from sliding off the mounting plate comprises:

elongating the receptacle along a y-axis to allow the receptacle to be placed onto the mounting plate and slide downward, one or more protrusions at a top of the receptacle that extend over a backside of the mounting plate to prevent the receptacle from moving away from the mounting surface.

10. The method of claim 8 wherein the means for fixedly attaching the solid-core substrate in the rabbet area comprises a plurality of brackets that slide onto corners or sides of the solid-core substrate whereby the brackets overlay one or more back edges of the frame and are affixed to a back of the frame.

11. The method of claim 8 wherein the means for leveling the mounting plate on the mounting surface before the mounting plate is removably attached to the mounting surface is a bubble vial affixed to the mounting plate.

12. The method of claim 8 wherein the means for leveling the mounting plate on the mounting surface before the mounting plate is removably attached to the mounting surface is a bubble vial removably affixed to the mounting plate.

13. The method of claim 8 wherein said mounting plate has a plurality of standoffs on a backside surface of the mounting plate to allow the mounting plate to be leveled on the mounting surface before the mounting plate is removably attached to the mounting surface.

14. The method of claim 8 wherein said solid-core substrate is one of foamcore, plastic, wood, composite, or metal.

15. The method of claim 8 wherein the mounting plate is removably attached to the mounting surface with an adhesive strip.

16. The method of claim 8 wherein the mounting plate is removably attached to the mounting surface using a mechanical fastener.

17. The method of claim 8 wherein the mounting plate is removably attached to the mounting surface using an adhesive strip and one or more mechanical fasteners.

18. A method for leveling and mounting a framed image on a mounting surface, the method comprising:

placing an image of the framed image in a frame of the framed image, fixedly attaching a solid-core substrate at a back of a rabbet area of the frame, making a cut-out at or near a center of the solid-core substrate to form a receptacle, wherein a shape and size of the receptacle are designed for removably placing the receptacle over and onto a mounting plate, wherein a shape and size of said mounting plate are designed to fit within the receptacle, wherein said mounting plate defines a bull's-eye opening at a center of the mounting plate, the bull's eye opening being configured for aligning the mounting plate over a predetermined point on the mounting surface, and wherein the mounting plate contains a means for leveling the mounting plate on the mounting surface before the mounting plate is removably attached to the mounting surface, placing the bull's eye opening of the mounting plate over the predetermined point on the mounting surface, leveling the mounting plate on the mounting surface, removably attaching said level mounting plate onto the mounting surface, and placing the receptacle over and onto the level mounting plate;

wherein the shape and size of the receptacle, and an orientation of said receptacle, are designed so that the framed image is level when mounted onto the level mounting plate, wherein one of the receptacle or the mounting plate has a means for preventing the receptacle from sliding away from the mounting surface and off of the mounting plate, and wherein the framed image is flush to the mounting surface.

19. The method of claim 18 wherein the means for preventing the receptacle from sliding off the mounting plate comprises a rubber ring on an outer edge of the mounting plate that interfaces with an inner surface of the receptacle.

20. The method of claim 18 wherein the means for fixedly attaching the solid-core substrate in the rabbet area comprises a plurality of brackets that slide onto corners or sides of the solid-core substrate whereby the brackets overlay one or more back edges of the frame and are affixed to a back of the frame.

21. The method of claim 18 wherein the means for leveling the mounting plate on the mounting surface before the mounting plate is removably attached to the mounting surface is a bubble vial affixed to the mounting plate.

22. The method of claim 18 wherein said solid-core substrate is one of foamcore, plastic, wood, composite, or metal.

23. The method of claim 18 wherein the mounting plate is removably attached to the mounting surface with an adhesive strip.

24. The method of claim 18 wherein the mounting plate is removably attached to the mounting surface using a mechanical fastener.

25. The method of claim 18 wherein the mounting plate is removably attached to the mounting surface using an adhesive strip and one or more mechanical fasteners.

26. The method of claim 18 wherein the means for leveling the mounting plate on the mounting surface before the mounting plate is removably adhered to the mounting surface is a bubble vial removably affixed to the mounting plate.

27. The method of claim 18 wherein the means for leveling said mounting plate is a plurality of standoffs on a backside surface of the mounting plate to allow the mounting plate to be leveled on the mounting surface before the mounting plate is removably adhered to the mounting surface.

28. A method for leveling and mounting a plurality of framed images on a mounting surface, the method comprising:

placing each image of the plurality of framed images in a respective frame of the plurality of framed images, fixedly attaching a solid-core substrate at a back of a rabbet area of each said frame, making a cut-out at or near a center of each said solid-core substrate for placement of a receptacle, wherein each said receptacle is affixed in the cut-out of each said substrate using a respective coupling plate that locks onto the receptacle with the solid-core substrate sandwiched in between the receptacle and the coupling plate, wherein a shape and size of each said receptacle are designed for removably placing the receptacle over and onto a corresponding mounting plate, wherein a shape and size of each said mounting plate are designed to fit within the respective receptacle, wherein each said mounting plate defines a bull's-eye opening at a center of the respective mounting plate, each bull's eye opening being configured for aligning the respective mounting plate over a respective predetermined point on the mounting surface, and wherein the respective predetermined point for each said mounting plate is identified using a template placed onto the mounting surface;

wherein said template identifies a location of each said framed image in relationship to respective locations of each of the other said framed images, identifies a location of the receptacle for each said framed image, and identifies a center point for each said receptacle, and wherein each said mounting plate contains a means for leveling the mounting plate on the mounting surface before each said mounting plate is removably attached to the mounting surface, placing the bull's eye opening of each said mounting plate over its respective predetermined point on the mounting surface, leveling each said mounting plate on the mounting surface, removably attaching each said level mounting plate onto the mounting surface, and placing the receptacle for each corresponding framed image over and onto the level mounting plate for that framed image;

wherein the shape and size of each receptacle, and an orientation of each said receptacle, are designed so that each said framed image is level when mounted onto the level mounting plate for said framed image, wherein one of each said receptacle or each said mounting plate has a means for preventing the receptacle from sliding away from the mounting surface and off of the mounting plate, and wherein each said framed image is flush to the mounting surface.

29. A method for leveling and mounting a plurality of framed images on a mounting surface, the method comprising:

placing each image of the plurality of framed images in a respective frame of the plurality of framed images, fixedly attaching a solid-core substrate at a back of a rabbet area of each said frame, making a cut-out at or near a center of each said solid-core substrate to form a receptacle for each framed image, wherein a shape and size of each said receptacle are designed for removably placing the receptacle over and onto a corresponding mounting plate, wherein a shape and size of each said mounting plate are designed to fit within the respective receptacle, wherein each said mounting plate defines a bull's-eye opening at a center of the respective mounting plate, each bull's eye opening being configured for aligning the respective mounting plate over a respective predetermined point on the mounting surface, and wherein the respective predetermined point for each said mounting plate is identified using a template placed onto the mounting surface;

wherein said template identifies a location of each said framed image in relationship to respective locations of each of the other said framed images, identifies a location of the receptacle for each said framed image, and identifies a center point for each said receptacle, and wherein each said mounting plate contains a means for leveling the mounting plate on the mounting surface before each said mounting plate is removably attached to the mounting surface, placing the bull's eye opening of each said mounting plate over its respective predetermined point on the mounting surface, leveling each said mounting plate on the mounting surface, removably attaching each said level mounting plate onto the mounting surface, and placing the receptacle for each corresponding framed image over and onto the level mounting plate for that framed image;

wherein the shape and size of each receptacle, and an orientation of each said receptacle, are designed so that each said framed image is level when mounted onto the level mounting plate for said framed image, wherein one of each said receptacle or each said mounting plate has a means for preventing the receptacle from sliding away from the mounting surface and off of the mounting plate, and wherein each said framed image is flush to the mounting surface.

30. A device for mounting on a mounting surface a frame having a framed image, the device comprising:

a mounting plate and a receptacle, wherein the receptacle is designed to be located in a cut-out at or near a center of a solid-core substrate that is fixedly attached in a rabbet area of the frame behind the framed image;

wherein the receptacle is fixedly attached into the cut-out using a coupling plate that locks the receptacle into the cut-out with the solid-core substrate between the coupling plate and the receptacle, wherein the mounting plate has a bull's-eye opening at a center of the mounting plate for aligning the mounting plate over a predetermined point on the mounting surface, wherein the mounting plate contains a means for leveling the mounting plate on the mounting surface before the mounting plate is removably adhered to the mounting surface, wherein a size, shape, and orientation of the receptacle allow the framed image to be level on the mounting surface when mounted onto a level mounting plate, wherein one or both of the receptacle or the mounting plate has a means for preventing the receptacle from sliding off the mounting plate.

31. The device of claim 30 wherein the means for preventing the receptacle from sliding off the mounting plate comprises:

elongating the receptacle along a y-axis to allow the receptacle to be placed onto the mounting plate and slide downward, and one or more protrusions at a top of the receptacle that extend over a backside of the mounting plate to prevent the receptacle from moving away from the mounting surface.

32. The device of claim 30 wherein the means for leveling the mounting plate on the mounting surface before the mounting plate is removably adhered to the mounting surface is a bubble vial affixed to the mounting plate.

33. The device of claim 30 wherein the means for leveling the mounting plate on the mounting surface before the mounting plate is removably adhered to the mounting surface is a bubble vial removably affixed to the mounting plate.

34. The device of claim 30 wherein the means for leveling said mounting plate is a plurality of standoffs on a backside surface of the mounting plate to allow the mounting plate to be leveled on the mounting surface before the mounting plate is removably adhered to the mounting surface.

* * * * *